US009347305B2

(12) United States Patent
Nydahl et al.

(10) Patent No.: US 9,347,305 B2
(45) Date of Patent: May 24, 2016

(54) METHOD AND SYSTEM FOR CONTROLLING A POWER SOURCE AT A ROCK DRILLING APPARATUS AND ROCK DRILLING APPARATUS

(75) Inventors: Anders Nydahl, Filipstad (SE); Erik Aldèn, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 555 days.

(21) Appl. No.: 13/261,585

(22) PCT Filed: Aug. 25, 2011

(86) PCT No.: PCT/SE2011/051024

§ 371 (c)(1),
(2), (4) Date: Feb. 4, 2013

(87) PCT Pub. No.: WO2012/026873

PCT Pub. Date: Mar. 1, 2012

(65) Prior Publication Data

US 2013/0161095 A1 Jun. 27, 2013

(30) Foreign Application Priority Data

Aug. 26, 2010 (SE) ..... 1000871

(51) Int. Cl.
*E21B 44/06* (2006.01)
*E21B 44/00* (2006.01)

(52) U.S. Cl.
CPC ..... *E21B 44/00* (2013.01); *E21B 44/06* (2013.01)

(58) Field of Classification Search
CPC ..... E21B 44/00; E21B 44/06
See application file for complete search history.

(56) References Cited

U.S. PATENT DOCUMENTS

| | | | | |
|---|---|---|---|---|
| 6,276,449 | B1 | 8/2001 | Newman | |
| 6,517,465 | B2 | 2/2003 | Hrazdera | |
| 7,503,409 | B2 | 3/2009 | Brookover | |
| 7,533,730 | B1 * | 5/2009 | Corsentino | 166/369 |
| 2007/0163806 | A1 * | 7/2007 | Carlson et al. | 175/40 |
| 2009/0095527 | A1 * | 4/2009 | Lane et al. | 175/25 |

FOREIGN PATENT DOCUMENTS

| | | |
|---|---|---|
| GB | 2 177 820 | 1/1987 |
| WO | WO97/47858 | 12/1997 |
| WO | WO98/16712 | 4/1998 |
| WO | WO2006/135303 | 12/2006 |
| WO | WO2009/052304 | 4/2009 |
| WO | WO2009/145704 | 12/2009 |

* cited by examiner

*Primary Examiner* — Giovanna C Wright
(74) *Attorney, Agent, or Firm* — Mark P. Stone

(57) ABSTRACT

The present invention relates to a method for controlling a power source (9) at a rock drilling apparatus, said power source (9) being arranged to drive at least a first load (8, 10, 15) at the rock drilling apparatus, wherein said first load (8, 10, 15), in operation, provides power to a first consumer (11, 21), and where the power that can be delivered by- said first load (8, 10, 15) depends on the rotation speed of the power source. The method includes, by means of a representation of said first consumer (11, 21), determining a power demand of said first consumer (11, 21), and based on said determined power demand, determine a rotation speed demand of said first load (8, 10, 15). The rotation speed of said power source is then controlled based at least on said determined rotation speed demand of said first load (8, 10, 15 ). The invention also relates to a system and a rock drilling apparatus.

19 Claims, 3 Drawing Sheets

METHOD AND SYSTEM FOR CONTROLLING A POWER SOURCE AT A ROCK DRILLING APPARATUS AND ROCK DRILLING APPARATUS

FIELD OF THE INVENTION

The present invention relates to methods and systems for controlling power sources, and in particular to a method for controlling a power source during rock drilling. The invention also relates to a system and a rock drilling apparatus.

BACKGROUND OF THE INVENTION

Rock drilling apparatuses may be used in a number of areas of application. For example, rock drilling apparatuses may be used in tunneling, underground mining, rock reinforcement, raise boring, and for drilling of blast holes, grout holes and holes for installing rock bolts, etc.

A drill tool such as, for example, a drill bit is often used during drilling, the drill bit being connected to a drilling machine, in general by means of a drill string. The drilling can be accomplished in various ways, e.g. as rotational drilling where the drill tool is pushed towards the rock at high pressure and then crushes the rock by means of rotation force and applied pressure.

Percussive drilling machines can also be used, where, for example, a piston strikes the drill string to transfer percussive pulses to the drill tool via the drill string and then further on to the rock. Percussive drilling is often combined with a rotation of the drill string in order to obtain a drilling where the buttons of the drill bit strikes fresh rock at each stroke, thereby increasing the efficiency of the drilling.

During drilling the drill tool can be pressed against the rock by means of a feed force to ensure that as much impact energy as possible from the hammer piston is transmitted to the rock.

In general, the rock drilling apparatus further includes a power source, such as, for example, a combustion engine (e.g. a diesel engine) or an electric motor, which is used to generate required power to the various functions of the rock drilling apparatus. The power that is required by the various functions of the rock drilling apparatus can be arranged to be provided mainly by one power source, such as a combustion engine or an electric motor, the power source thereby constituting a main power source.

Percussion force, rotation force, feed force, etc. are, in general, generated by means of hydraulic flows from hydraulic pumps which constitute loads of the power source and hence are driven by the power source. The power source can also power cooling fans, as well as other consumers/loads, such as means for propelling the rock drilling apparatus. The loads of the power source are often directly connected to, and hence driven by, the output shaft of the power source, i.e. the power that can be provided by the load to a consumer of the load is dependent on the rotation speed of the power source.

In general rock drilling apparatuses also include means for generating flushing pressure/flow for evacuation of the drilling remnants, the so called drill cuttings, that are generated during drilling.

This is usually accomplished by means of a flushing medium, such as, for example, compressed air, flushing air, which is led through a channel in the drill string for release through flushing air holes in the drill bit to thereafter bring the drilling remnants on its way up through the hole. The pressure/flow of the flushing medium can be generated by means of a compressor which is also driven by the output shaft of the power source. Consequently, the power that can be discharged by the compressor is also directly dependent on the rotation speed of the power source.

According to the prior art the rotation speed of the power source is controlled, in so much the speed is at all controlled, based on few input parameters. For example, the motor speed can be controlled based on chosen mode of operation, such as for example, the modes of operation movement, drilling, or drill rod handling. Also, in some situations the operator can manually set the speed of the power source for various modes of operation during operation.

The rotation speed at the various modes of operation is often chosen such that the full capacity of the drilling rig is available for all active consumers at all times at the current mode of operation. During drilling, for example, the percussion mechanism (percussion force), rotation force, feed force and flushing air. In order to ensure a correct function the power source is therefore in general dimensioned such that all functions can be used at the same time, and at their maximum output powers.

The advantages of such a solution is that one and the same power source can be used as power source for all loads/consumers occurring at the drilling rig, such as compressor, hydraulic pumps/motors, percussion mechanism etc.

However, in many situations of operation the full capacity of the loads and/or consumers is not utilized, which also means that the power source many times is driven at a speed that is not optimal.

This also means that rock drilling apparatuses often consume more power than necessary during a drilling process, which results in excessive fuel consumption and also undesired generation of heat and noise.

Consequently, there exists a need for an improved control of rock drilling processes.

SUMMARY OF THE INVENTION

It is an object of the present invention to provide a method for controlling a power source at a rock drilling apparatus that solves the above problem. This object is achieved by means of a method according to claim 1.

The present invention relates to a method for controlling a power source at a rock drilling apparatus, said power source being arranged to drive at least a first load being arranged at the rock drilling apparatus, wherein said first load, in operation, provides power to a first consumer, and where the power that can be delivered by said first load depends on the rotation speed of the power source, the method including:

- by means of a representation of said first consumer, determining a power demand of said first consumer,
- based on said determined power demand, determine a rotation speed demand of said first load, and
- control the rotation speed of said power source based at least on said determined rotation speed demand of said first load.

The present invention has the advantage that the rotation speed of the power source can be set to a rotation speed where said first load can deliver a required power to said first consumer, but where the rotation speed of the power source at the same time must not be set to a too high rotation speed with excessive production of power that cannot be used in an efficient manner. According to an alternative where the power source is constituted by a combustion engine, unnecessary fuel consumption and noise can be reduced. The invention also has the advantage that wear on, for example, a combustion engine can be reduced since the combustion engine is not unnecessarily loaded. According to an alternative embodiment the power source is constituted by an electric motor. Use of an electric motor makes it possible to more freely control the rotation speed since an electric motor is not dependent on an idling speed in the same manner as a combustion engine.

When determining a rotation speed requirement of a load based on a determined power demand, a determined relation between the speed of the power source and the power that can be delivered by the said load can be used. The load can, for example, be directly connected to the power source, whereby the rotation speed of the load will completely correspond to the rotation speed of the power source. In this case the power that can be delivered by the load can be completely determined by means of a representation of the load, such as, for example, a mathematical relationship or a table that defines the power that can be delivered by the load in relation to the rotation speed of the load. In the case the load is connected to the power source by means of a gearing, a representation of the gearing can be used at the determination to translate the rotation speed of the power source to the rotation speed that the load will have.

Consequently, the present invention can ensure that the power source at all times will operate at a speed that is advantageous or optimal from a fuel consumption point of view, and accordingly also has the advantage that the function of the rock drilling apparatus does not become operator dependent in the same manner as when the rotation speed of the power source is set manually. A manual setting of the rotation speed of the power source requires plenty from the operator of the rock drilling apparatus, both from a handling point of view and from a knowledge point of view, in order to get the power source to operate at the most optimum engine rotation speed at a current point of operation. This has the result that the power source, and thereby one or more loads, in many operation situations (i.e. at drilling situations where the power requirement of one or more consumers is low) operate at an unnecessarily high speed which thereby is not optimal, e.g. from a fuel consumption point of view.

The power source can further be arranged to drive at least one second load being arranged at the rock drilling apparatus, whereby said second load, in operation, can deliver power to a second consumer, and where the power that can be delivered by said second load depends on the rotation speed of the power source. By determining a second power demand of said second consumer, and determining a second speed demand of said second load based on said second power demand, the rotation speed of the power source can be controlled based on said first and second speed demands.

The speed of the power source can be set to the highest of the speed demands that has been determined for said first and second load.

It can sometimes be advantageous that the speed of the power source can only be set to a plurality of fixed speeds. The speed of the power source can then be set to the higher fixed speed that is closest to the highest of the speed demands that has been determined for said first and second load.

According to the invention the power source is consequently controlled in such a manner that it delivers precisely, or substantially precisely, the rotation speed of the rotation speeds to which the power source can be set that at present is demanded.

In one embodiment the rotation speed of the power source is set to a fixed rotation speed that is at most 10% above or below the highest of the speed demands that has been determined for said first and second load. This has the advantage that the speed of the power source can be set to a rotation speed that is close to the determined speed demand, but that can deviate somewhat, e.g. due to the fact that there can be speeds at which the power source operate more efficiently, where a setting to such a speed can motivate a somewhat lower power takeout by setting the rotation speed of the power source to a somewhat lower speed than the determined speed demand.

According to the present invention, a power demand of a consumer is determined according to the above, such as, for example, a hydraulic flow demand, which is then communicated e.g. to the first load such as, for example, a hydraulic pump unit.

This has the advantage that the consumer can require a flow that is completely independent from the rotation speed at which the hydraulic pump must be driven in order to deliver a requested flow. This also means that the consumer can request a flow, where said request is completely independent from the type of hydraulic pump that is powering the consumer. Consequently, as seen from the consumer, it does not matter if it is a small or large hydraulic pump that powers the consumer, the only point of interest is that a desired flow is obtained. This also means that the hydraulic pump can be replaced from one type to another without the manner in which a requested hydraulic flow is determined must be changed, since the responsibility for obtaining a "correct" flow is completely the responsibility of the load.

Consequently, components can be replaced in a simple manner without necessarily affecting the portions of the control system that relate to units controlling/being controlled by a replaced component.

The power source can constitute a main power source, where the main power source can provide power to a plurality or all of the loads that are being present at the rock drilling apparatus and that have power demands.

Further characteristics of the present invention and advantages thereof will be apparent from the following detailed description of exemplary embodiments and the enclosed drawings.

DETAILED DESCRIPTION OF EXEMPLARY EMBODIMENTS

Figure 1:
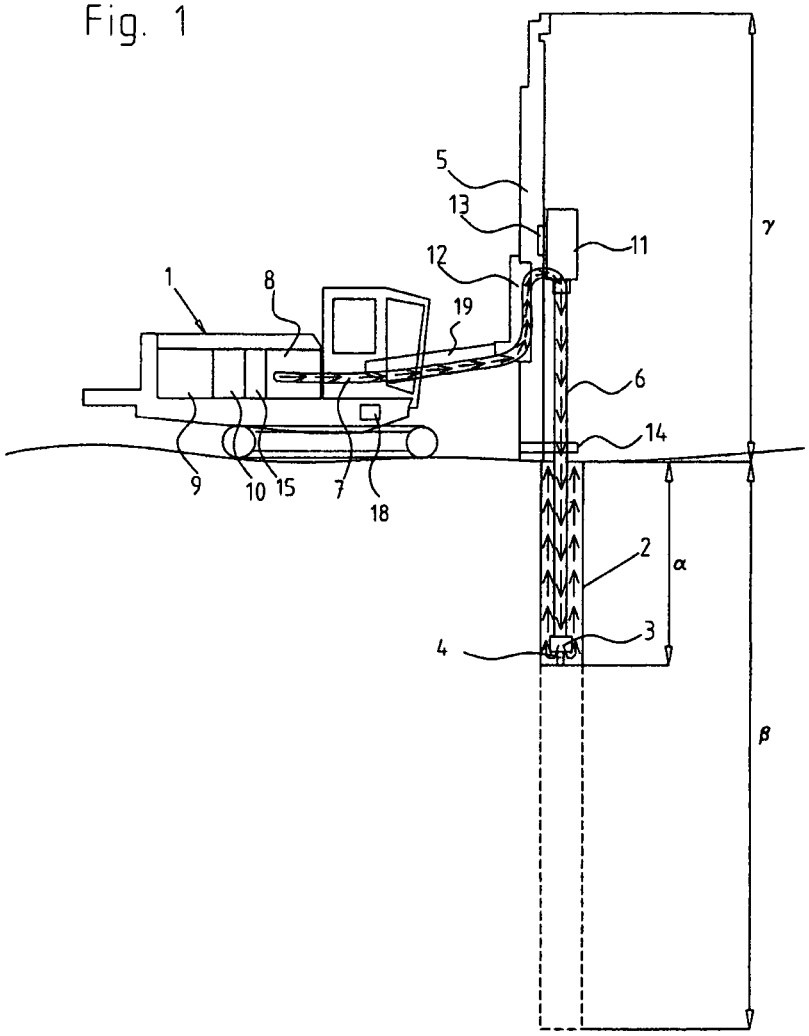
FIG. 1 discloses a rock drilling apparatus at which the present invention advantageously can be utilized.

FIG. 1 shows a rock drilling apparatus according to a first exemplary embodiment of the present invention for which an inventive control of a compressor will be described.

The rock drilling apparatus shown in FIG. 1 includes a drilling rig 1, in this example a surface drilling rig, which carries a drilling machine in the form of a top hammer drilling machine 11.

The drilling rig 1 is shown in use, drilling a hole 2 in rock, which starts at the surface and where the drilling at present is at a depth $\alpha$. The hole is intended to result in a hole having the depth $\beta$, which, depending on area of use, can vary to large extent from hole to hole and/or from area of use to area of use. The finished hole is indicated by dashed lines. (The shown relationship between drilling rig height and hole depth is not intended to be proportional in any way. The total height $\gamma$ of the drilling rig can, for example be 10 meters, while the hole depth $\beta$ can be both less than and considerably larger than 10 meters, e.g. 20 meters, 30 meters, 40 meters or more).

The top hammer drilling machine 11 is, via a drill cradle 13, mounted on a feed beam 5. The feed beam 5, in turn, is attached to a boom 19 via a feed beam holder 12. The top hammer drilling machine 11 provides, via a drill string 6 being supported by a drill string support 14, percussive action onto a drill tool in the form of a drill bit 3, which transfer shock wave energy from the top hammer drilling machine 11 onto the rock. For practical reasons (except possibly for very short holes) the drill string 6 does not consist of a drill rod in one piece but consists, in general, of a number of drill rods. When the drilling has progressed a distance corresponding to a drill rod length a new drill rod is threaded together with the one or more drill rods that already has been threaded together, whereby drilling can progress for another drill rod length before a new drill rod is threaded together with existing drill rods.

The top hammer drilling machine 11 is of hydraulic type, and is power supplied by means of a hydraulic pump 10 via hydraulic hoses (not shown) in a conventional manner. The hydraulic pump, in turn, is driven by a power source e.g. in the form of a combustion engine 9 such as a diesel engine (alternatively the power source 9 can consist of an electric motor).

In this exemplary embodiment the hydraulic pump 10 is driven by an output shaft of the combustion engine 9, and according to the present example the input shaft of the hydraulic pump 10 is connected to the output shaft of the combustion engine in such a way that the rotation speed of the input shaft of the hydraulic pump 10 is the same as the speed of the output shaft of the combustion engine. In an alternative embodiment the input shaft of the hydraulic pump is connected to the output shaft of the combustion engine via a suitable gearing.

In general, the power source 9 of a rock drilling rig of the above kind constitutes a main power source, where the main power source 9 provides power to various or all of the units present at the drilling rig that have power demands, such as for example loads in the form of hydraulic pumps, which in turn powers consumers, such as, for example, percussion mechanism, hydraulic motors etc.

In the present description and claims the term "load" is used to define a unit which is driven directly by the power source, while the term "consumer" is used to define a unit that is driven by a load, and thereby indirectly by the power source.

Another example of loads that can be driven by the power source consists of cooling fans. Further, another kind of common loads consists of compressors, and the rock drilling apparatus shown in FIG. 1 includes a compressor 8, which provides flushing medium in the form of compressed air. Flushing medium is used to flush drill holes clean from drilling remnants, also called drill cuttings, that are formed during drilling.

In the disclosed example the flushing air is led through the drill rods, which consists of thick walled pipes, e.g. made from steel. A channel formed through the drill string, in or through the walls of the rods in the longitudinal direction, is used to feed flushing air from the drilling rig 1 through the drill strings 6 for release through flushing air holes in the drill bit to thereafter bring drill cuttings on the way up through the hole in the space between drill rod and hole wall, as is indicated by the upwardly directed arrows in FIG. 1.

In order for the drill cuttings to follow the flushing air up through the hole and thereby avoid clogging of the flushing air holes, it is required that the flushing air achieves at least a minimum speed, and thereby flushing air flow, which primarily depends on the size form and density of the drill cuttings.

The compressor 8 is used to provide air to the drill bit in a conventional manner by pressing flushing air through the channel in the drill rods down to the drill bit.

According to the above the combustion engine 9 is the main power source of the drilling rig and should therefore be powerful enough to be able to simultaneously drive both compressor 8 and other loads connected to the combustion engine, such as the hydraulic pump 10 and a hydraulic pump 15, which drives a rotation motor for rotation of the drill string, at full power. The power that can be delivered by the combustion engine should also be high enough to simultaneously drive cooling fans, flushing air flow and the consumers that are driven by the compressor 8 and hydraulic pumps 10, 15, respectively, at full power. Further loads can also be arranged to be driven by the combustion engine, such as, for example, further hydraulic pumps, which in turn can drive other consumers arranged on the rock drilling apparatus, such as, for example, hydraulic motors for use in a conventional manner at rock drilling apparatuses.

The drilling rig also includes a control unit 18 which constitutes part of the drilling rig control system and which can be used to control various functions, such as, for example, control of the rotation speed of the combustion engine 9 according to the present invention and according to what will be described below.

According to the present invention, the rotation speed of the power source is controlled based on prevailing power demands of at least one of the consumers that indirectly are connected to the combustion engine. A power demand of said at least one consumer is determined by means of representation of the consumer, whereby the power demand of the consumer thus can be determined by calculation and/or e.g. table look-up and thereby without the need for use of sensor signals during the determination.

In this description and the following claims the term "representation" means an arbitrarily suitable way of describing a load or consumer. The representation can, for example, consist of a software representation, i.e. be implemented in the form of a computer program. The representation can further, for example, consist of a mathematical expression, where a power/rotation speed demand is determined by means of a calculation based on one or more input parameters. Alternatively, the representation can, for example be in the form of a list such as e.g. in the form of a table.

Figure 2:
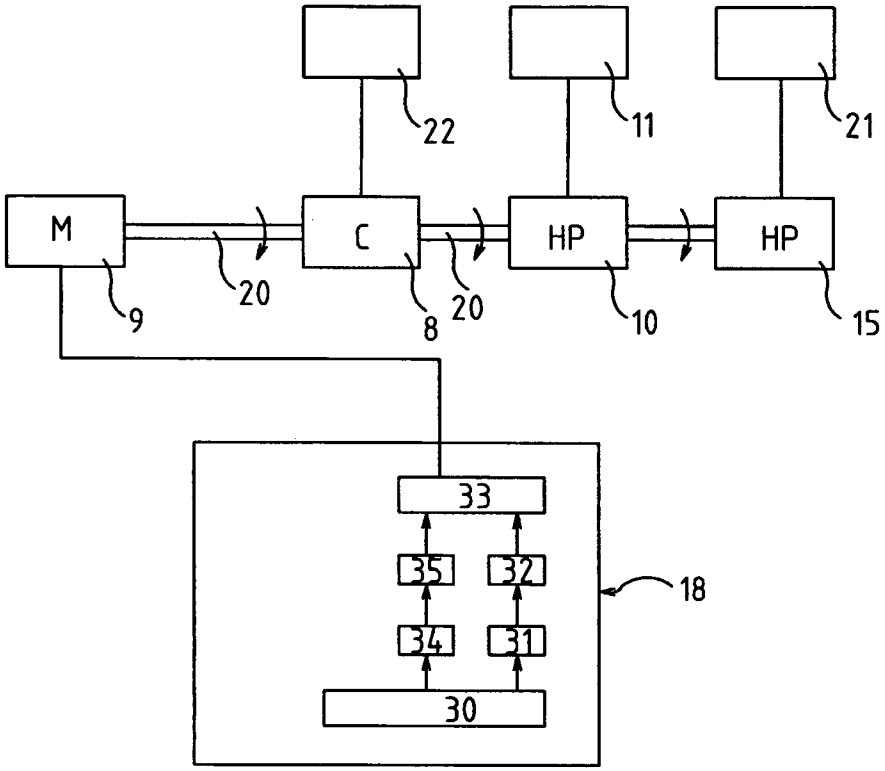
FIG. 2 discloses power source, loads and consumers of the rock drilling apparatus of FIG. 1 more in detail.

In FIG. 2 the power source 9, loads and consumers of the rock drilling apparatus are shown more in detail. FIG. 2 shows the combustion engine 9 with hydraulic pumps 10, 15 and the compressor 8 directly connected to the output shaft 20 of the power source. For simplicity, the loads connected to the power source 9 are shown as being directly connected to the output shaft of the power source 9, but as has been mentioned, according to an alternative embodiment one or more of the loads can be connected to the output shaft 20 of the combustion engine via a suitable gearing.

According to the above the hydraulic pump 10 controls the top hammer percussion mechanism 11 while the hydraulic pump 15 controls one (or more) rotation motor(s) 21 for rotation of the drill string. FIG. 2 also shows the compressor 8. The compressor 8 generates pressurized air that is supplied to a separator tank 22, where oil that has been added during compression is separated from the pressurized air. The pressurize air that is provided to the separator tank 22 is then used as flushing medium according to the above. As also has been mentioned, further non-disclosed loads can be arranged to be driven by the power source 9.

Figure 3:
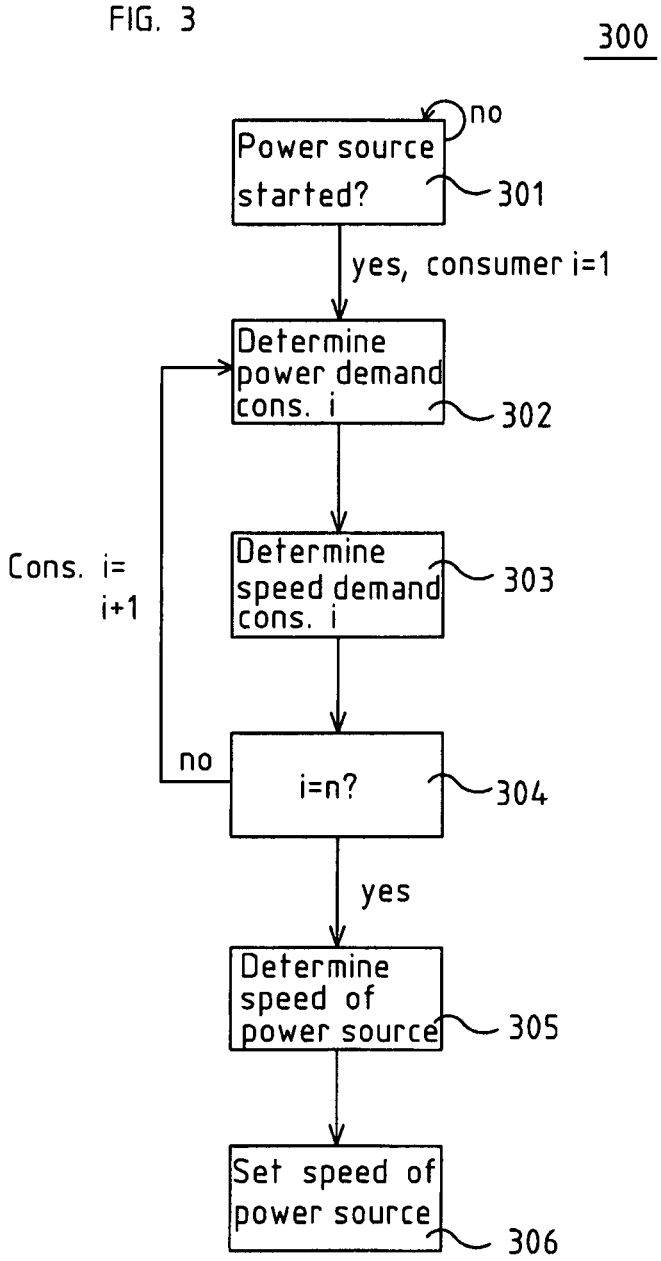
FIG. 3 discloses a flow chart of an exemplary embodiment for determining a rotation speed of a power source according to the present invention.

An exemplary embodiment 300 according to the present invention for determining a rotation speed of the power source 9 is shown in FIG. 3. In step 301 it is determined if the power source is started, and if this is the case the method continues to step 302 at the same time as a variable "consumer" is set to i=1. Each consumer of the rock drilling apparatus (or at least the consumer/consumers for which a determination according to the present invention is to be performed) is designated a serial number i, whereby the consumer can be identified by means of said serial number i.

In step 302 the power demand of consumer i, i.e. in this case consumer 1, which can consist of any suitable consumer, is determined. In the present example, the consumer i=1 consists of the rotation motor 21. With regard to the consumers connected to hydraulic pumps, such as rotation motor 21, this power demand is a hydraulic flow demand.

According to the present example this determination is performed by means of determination means in the form of a computer program. For example, the control means that are used for controlling the consumer can consist of a dedicated computer program section in a control unit, whereby the computer program section can be exchangeable without other computer program sections having to be affected. Further, a software representation of the consumer is used at the determination, where the software representation can be integrated in said computer program section. For example, a consumer, such as the rotation motor 21, can be represented by a representation in the form of a mathematical expression, whereby the power demand is determined by means of a calculation based on one or more input parameters according to the below. Alternatively, the consumer can be represented by a representation in the form of a list, such as, for example, a table format, where the power demand is determined by extracting a value from the table/listing representing the power demand based on one or more input parameters, and where the values of the power demand can be stated for a large number of values of each input parameter, respectively, as well as combinations of various values of input parameters. The determination of the power demand can, for example, also be performed by means of a combination of the above methods. The means for determination can also consist of, for example, a hardware implementation, e.g. by means of an ASIC (Application Specific Integrated Circuit).

The input parameters that are used when determining the power demand can be determined by the process/portion of the control system of the rock drilling apparatus that controls the ongoing operation of the rock drilling apparatus. The rotation motor 21 is in the present example used for rotation of the drill string during ongoing drilling, whereby input parameters are obtained from the control of the drilling process. This overall control can, for example, determine that drilling using a certain percussion force, such as, for example, any suitable portion of a maximal percussion force, is to prevail, and also that a certain rotational force and/or a certain rotational speed of the drill string is required.

By means of the representation of the rotation motor 21 a hydraulic flow by means of which the rotation must be driven is determined, i.e. the hydraulic flow that must be obtained from the hydraulic pump 15 in order to obtain a desired rotation speed/rotation force of the drill string is to be obtained. As seen from the overall control of the drilling process perspective, this consequently means that it is enough to request a rotational speed and/or rotational force of the drill string from the rotation motor 21 without having to take into consideration which kind of rotation motor that is actually used. Consequently, still as seen from the perspective of the overall control of the drilling process, the hydraulic motor 21 can be replaced by a completely different kind of hydraulic motor without this influencing the control signals of the overall control with the respect to the rotation motor 21.

The overall control of the drilling process, consequently, must not take into consideration which kind of rotation motor that is used, with the advantage that this portion of the rock drilling apparatus control system must not be changed/reprogrammed in case, for example, the rotation motor 21 is replaced by a rotation motor of different kind.

The principle of this functionally divided control system is exemplified in FIG. 2, where portions of the control unit 18 are disclosed. The overall control of the drilling process is shown as 30, and the representation of the rotation motor 21 is shown as 31.

Consequently, when the power demand of the rotation motor 21 has been determined in step 302 by means of the representation 31 of the rotation motor 21, the speed $\omega_i$ by means of which the hydraulic pump 15 must be driven in order to discharge a desired flow is determined in step 303.

This is accomplished in a way analogous to the above, i.e. the portion 31 of the control system that controls the rotation motor 21 requests the hydraulic flow determined according to the above from the portion 32 of the control system (those determination means) that controls the hydraulic pump 15.

When the flow request from the portion of the control system that relates to the rotation motor 21 has been received from the portion of the control system that relates to the hydraulic pump 15 this flow request is used to calculate the lowest speed $\omega_i$ at which the hydraulic pump 15 must be rotated by the power source 9 in order to be able to deliver a desired flow to the rotation motor 21. Since the hydraulic pump 15 in the disclosed embodiment is directly connected to the shaft of the power source 9 this calculated speed $\omega_i$ is also the lowest speed that the power source 9 must be driven at, as seen from the hydraulic pump 15. This calculated speed is then communicated to the portion (the control means) 33 of the control system that controls the power source 9, whereby the lowest speed that the power source must be driven at $\omega_{e_min}$ is set to $\omega_i$.

The method then continues to step 304, where is determined if the variable "consumer" has reached the value n. If this is not the case "consumer" is incremented by one, whereby the method returns to step 302 to determine the power requirement of consumer i+1. In the present example, e.g. the top hammer percussion mechanism 11.

The principle of this determination is completely analogous to the above, i.e. the overall control of the drilling process 30 requests a percussion pressure from the portion 34 of the control system that controls the percussion mechanism 11. With regard to the top hammer percussion mechanism, the percussion mechanism does not work continuously in the same manner as, for example, the rotation motor, but intermittently, but by means of the percussion pressure, which, for example, can be obtained as control signal from the overall control of the drilling process 30, the flow of the percussion mechanism can be calculated by means of a function describing how the percussion mechanism flow is dependent on the percussion pressure. This pressure/flow characteristic can, for example, be stated in data sheets, whereby these data sheets can be stored in the control system. Alternatively, pressure/flow characteristic can be measured during manufacturing for the specific percussion mechanism, or alternatively for a percussion mechanism specified by type.

When the hydraulic flow demand of the percussion mechanism has been determined, a hydraulic flow is requested from the portion 35 of the control system that controls the hydraulic pump 10 according to the above, whereby the lowest speed at which the hydraulic pump 10 must be rotated by the power source 9 in order to deliver a desired flow to the percussion mechanism 11 also can be determined in step 303. The calculated speed is communicated to the portion 33 of the control system that controls the power source 9, whereby $\omega_{e_min}$ is set to the highest of the various calculated $\omega_i$.

Step 302-304 are then repeated until the required speed, as seen from each of the loads being connected to the power source, has been determined. As is realized the hydraulic pumps 10, 15 can be arranged to drive further non-disclosed consumers, whereby the above determination can be performed for each of the consumer that is driven by one and the same hydraulic pump, and wherein the flow demand of a hydraulic pump can take into consideration the accumulated flow demand of two or more consumers if these are simultaneously driven by one and the same hydraulic pump, whereby the rotation speed demand of the hydraulic pump consequently also becomes higher.

The speed demand of the compressor is determined in a similar manner, where this, in principle, at least during ongoing drilling, depends on the flushing air demand. The compressor can, for example, be arranged to be controlled according to the method that is described in the parallel application PCT/SE2011/051027 "Method and system for controlling a compressor at a rock drilling apparatus" having the same inventor and filing date as the present application. According to the method described in said application, it is disclosed a solution where the compressor works according to a first mode and second mode, respectively, and wherein in said first mode the discharged flow of the compressor is arranged to be controlled by controlling the rotation speed of said compressor, and wherein in said second mode the discharged flow of the compressor is arranged to be controlled by controlling the air flow at the compressor inlet. Consequently, the rotation speed demand of the compressor can be arranged to be determined according to the method disclosed in said application.

When the speed demand then has been determined for all consumers and loads, i.e. when the condition in step 304 is fulfilled, the method continues to step 305 for determination of the rotation speed of the power source. This can, for example be accomplished by, by means of the portion 33 of the control system that controls the power source 9, comparing the rotation speeds of the power source that has been determined according to the above, whereby the power source in step 306 can be set to the highest of said rotation speeds so as to cater for requests from all consumers while the power source 9 at the same time is not driven at an unnecessarily high speed. During control of the rotation speed of the power source the control unit can receive a current speed of the power source, e.g. by means of a speed sensor arranged at the output shaft of the power source or at any of the connected loads.

As has been described, the power source can be set to the highest of the rotation speeds that has been requested from any of the loads of the power source. The rotation speed of the power source can alternatively be set to any of a number of fixed speeds, where the speed can be set to the fixed speed that is closest to the highest of said received speed requests, but still higher than the highest of said received speed requests. Such a solution can, for example, be to prefer from a dimensioning point of view since only a number of rotation speeds of the power source, which are known beforehand, needs to be taken into consideration. Further, at least in case the power source consists of a combustion engine, the speed must at least be the idling speed of the combustion engine. If the speed that has been determined according to the method of FIG. 3 is lower than the idling speed of the combustion engine, the speed of the combustion engine can be set to the idling speed instead.

According to the above the speed of the power source can alternatively be set to a fixed speed that is at maximum 10% above or below the highest of the speed demands that has been determined for said first and second load.

Preferably, the system is dimensioned such that the power source is always capable of delivering the maximum power demand that can arise while at the same time the highest requested speed can be met.

Alternatively, there can exist situations when the speed that has been determined according to the above consists of a speed at which the power that can be delivered by the power source does not amount to the requested power, whereby a requested power consequently can not be taken out, and whereby the rotation speed of the power source can be set to a rotation speed at which a maximum power of the power source can be taken out in order to as much as possible meet current requirements.

Consequently, a control of the rock drilling apparatus according to the present invention has the result that the control system implementation for controlling the power source can be designed in such a manner that results in the power source being driven at a rotation speed that as close as possible coincides with an "optimum" speed.

The system can further be arranged to continuously and automatically adapt the speed of the power source to the operation point that at the moment is most favourable without the rig functions being affected in a negative manner. It is to be understood that the control of the speed of the power source can be continuous, i.e. the method according to FIG. 3, and thereby the determination of required speed, can, for example, be performed continuously, every second, every 5 second, every 10 second or by any suitable interval. The speed of the power source can consequently be changed continuously during operation, e.g. due to activation/deactivation of other loads/consumers that are driven by the power source, or alternatively changing demands e.g. during drilling, such as increased/decreased percussion pressure, increased/decreased flushing air demand etc.

The control of the rock drilling apparatus according to the present invention also has the result that components in a simple manner can be replaced without necessarily affecting portions of the control system that relate to units that controls or is controlled by a replaced component.

For example, since the control of the rotation motor 21 requests a desired flow from the hydraulic pump 15, the control of the rotation motor does not have to "care about" which kind of hydraulic pump that actually is driving the rotation motor. That is, as seen from the rotation motor it does not matter if it is a small hydraulic pump being driven at a high speed or whether it is a larger hydraulic pump being driven at a lower speed. Consequently, the hydraulic pump 15 can be replaced by another kind of hydraulic pump without demand for changes of the control of the drilling rig in regard of the rotation motor, or in regard of the overall control of the rock drilling process. Correspondingly, this applies to other loads and consumers being controlled according to the present invention. According to one embodiment all loads/consumers being present at the rock drilling apparatus and being driven directly or indirectly by the power source are controlled according to the present invention. According to another embodiment only a portion of said loads/consumers are controlled according to the present invention while other loads/consumers can be controlled in another manner, or not at all.

As is realized a solution according to the present invention can still lead to certain loads/consumers having a lower speed demand than the determined $\omega_{e_min}$ that the power source will be driven at. In one embodiment this is handled by letting the load/consumer working at a higher power than what is actually necessary. This however, results in losses that are directly dependent on the overcapacity.

It can, however be advantageous to design the system such that operation situations where the available flow is higher than desired can be handled so as to as much as possible reduce excessive power consumption. In case the hydraulic pumps are driven at a higher speed than what is required by the consumer(s) being connected to the hydraulic pumps, the excessive pump capacity can, for example, be bypassed to a tank. This, however also results in losses that directly depends on the overcapacity. In case hydraulic pumps having a variable displacement are used, the displacement can be reduced on demand, which is considerably more efficient at partial load even if the reduced displacement somewhat generates increased losses due to reduced efficiency.

In one embodiment one or more of said consumers and loads includes a dedicated control unit, whereby, for example, a rotation speed request can be sent to a dedicated control unit of the rotation motor, which then sends the request of flow demand to the control unit of the hydraulic pump that drives the rotation motor, which in turn can determine a required speed which then is sent, e.g. to the control unit of the power source.

The invention has been described above in connection to a surface drilling rig, which carries a drilling machine in the form of a top hammer drilling machine. The invention, however, is also applicable for control of, for example, DTH (Down-The-Hole) drilling devices, as well as in connection to under-ground rigs.

Further, the invention has been described above in connection to a method for controlling a power source where the speed of the power source is controlled based on a rotation speed demand that has been obtained by means of a representation of a consumer. According to one embodiment, at least one sensor is used to determine a power demand of at least one additional consumer, whereby the power source is controlled on the basis of both the representation of at least one consumer, and signals from at least one sensor for determining the power demand of at least one additional consumer.

The invention claimed is:

1. Method for controlling a power source at a rock drilling apparatus, said power source being arranged to drive at least a first load at the rock drilling apparatus, wherein said first load in operation, provides power to a first consumer, and where the power that can be delivered by said first load depends on the rotation speed of the power source, the method including:

by means of a representation of said first consumer, determining a power demand of said first consumer, based on said determined power demand, determining a rotation speed demand of said first load, wherein, when determining a rotation speed demand of said first load based on a determined power demand, a determined relation between the rotation speed of the power source and the power that can be delivered by said first load is used, and controlling the rotation speed of said power source based at least on said determined rotation speed demand of said first load.

2. Method according to claim 1, wherein said power source is arranged to drive at least one second load at the rock drilling apparatus, where said second load, in operation, provides power to a second consumer, and where the power that can be delivered by said second load depends on the rotation speed of the power source, the method further including:

determining a second power demand of said second consumer, determining a second speed demand of said second load based on said second power demand, and controlling the rotation speed of the power source based on the speed demands of said first and second loads.

3. Method according to claim 2, wherein said second power demand of said second consumer is determined by means of a representation of said second consumer.

4. Method according to claim 3, wherein the method further includes setting the rotation speed of the power source to the highest of the rotation speed demands that has been determined for said first and second loads.

5. Method according to claim 2, wherein the method further includes setting the rotation speed of the power source to the highest of the rotation speed demands that has been determined for said first and second loads.

6. Method according to claim 2, wherein the rotation speed of the power source can be set to a plurality of fixed rotation speeds, wherein the method further includes setting the rotation speed of the power source to the fixed rotation speed that is closest above the highest of the rotation speed demands that has been determined for said first and second loads.

7. Method according to claim 2, wherein the rotation speed of the power source can be set to a plurality of fixed rotation speeds, wherein the method further includes setting the rotation speed of the power source to a fixed rotation speed that is at most 10% above or below the highest of the rotation speed demands that has been determined for said first and second loads.

8. Method according to claim 1, wherein the power source consists of a combustion engine, where the rotation speed of the combustion engine is set to idling speed when said determined rotation speed demand is lower than the idling speed of the combustion engine.

9. Method according to claim 1, wherein the method further includes communicating said determined rotation speed demand of said first consumer from control means of said first consumer to control means of said first load.

10. Method according to claim 1, wherein said first consumer is used during rock drilling processes percussion and rotation.

11. Method according to claim 1, wherein said method is performed automatically by a control system of said rock drilling apparatus.

12. System for controlling a power source at a rock drilling apparatus, where said power source is arranged to drive at least a first load at the rock drilling apparatus, where said first load, in operation, is arranged to provide power to a first consumer, and where the power that can be delivered by said first load depends on the rotation speed of the power source, wherein the system includes:

determination means for determining a power demand of said first consumer by means of a representation of said first consumer, determination means for determining a rotation speed demand of said first load based on said determined power demand, wherein, when determining a rotation speed demand of said first load based on a determined power demand, a determined relation between the rotation speed of the power source and the power that can be delivered by said first load is used, and control means for controlling the rotation speed of said power source based at least on said determined rotation speed demand of said first load.

13. System according to claim 12, wherein said power source is arranged to drive at least one second load at the rock drilling apparatus, where said second loads, in operation, is arranged to provide power to a second consumer, and where the power that can be delivered by said second load depends on the rotation speed of the power source, the system further including:

determination means for determining a power demand of said second consumer, determination means for determining a speed demand of said second load based on said determined power demand, and control means for controlling the rotation speed of the power source based on the speed demands of said first and second load.

14. System according to claim 12, wherein said representation of said first consumer consists of a software representation of said first consumer.

15. System according to claim 12, wherein an input shaft of said first load is arranged to be driven by an output shaft of said power source such that the rotation speed of the load is linearly dependent on the rotation speed of the power source.

16. System according to claim 12, wherein said at least first load consists of a hydraulic pump, and the power demand of said at least first consumer consists of a hydraulic flow demand.

17. System according to claim 12, wherein said control means consists of a control unit or a dedicated computer program code in a control unit.

18. System according to claim 12, wherein the system further includes means for reducing the power provided to a consumer when the load being associated with said consumer is driven at a higher speed than said determined rotation speed demand.

19. Rock drilling apparatus, wherein said apparatus includes a system according to claim 12.

* * * * *